US011927010B2

(12) United States Patent
Warter

(10) Patent No.: US 11,927,010 B2
(45) Date of Patent: Mar. 12, 2024

(54) SYSTEM AND METHOD OF SECURING A ROOF TRUSS TO A LOAD-BEARING WALL

(71) Applicant: S.W. Engineering Inc., Delray Beach, FL (US)

(72) Inventor: Stephen W. Warter, Delray Beach, FL (US)

(73) Assignee: S.W. Engineering Inc., Delray Beach, FL (US)

( * ) Notice: Subject to any disclaimer, the term of this patent is extended or adjusted under 35 U.S.C. 154(b) by 0 days.

(21) Appl. No.: 18/319,796

(22) Filed: May 18, 2023

(65) Prior Publication Data

US 2023/0304290 A1 Sep. 28, 2023

Related U.S. Application Data

(63) Continuation-in-part of application No. 17/331,068, filed on May 26, 2021, now Pat. No. 11,692,348.

(51) Int. Cl.
*E04C 3/16* (2006.01)
*E04C 3/00* (2006.01)

(52) U.S. Cl.
CPC ..... *E04C 3/16* (2013.01)

(58) Field of Classification Search
CPC ..... E04C 3/16
USPC ..... 52/92.2, 92.1, 712
See application file for complete search history.

(56) References Cited

U.S. PATENT DOCUMENTS 1,519,627 A * 12/1924 Oliver ..... E04H 15/34 52/63
2,165,686 A * 7/1939 Suiter ..... E04B 2/66 52/236.6
3,040,479 A * 6/1962 Ayotte ..... E04G 23/0266 52/92.1
3,861,094 A * 1/1975 Jureit ..... E04B 1/2608 411/921
3,894,766 A * 7/1975 Woodward ..... B62D 33/0207 105/377.01
4,660,463 A * 4/1987 Bottomore ..... E04D 13/178 52/95
4,748,777 A * 6/1988 Glassco ..... E04C 2/16 52/92.3

(Continued)

FOREIGN PATENT DOCUMENTS

DE 3417837 A * 11/1985 ..... E04D 1/34
JP 2016079583 A * 5/2016 ..... E04B 1/2604

*Primary Examiner* — Brian D Mattei
*Assistant Examiner* — Joseph J. Sadlon
(74) *Attorney, Agent, or Firm* — Nancy J. Flint, Attorney At Law, P.A.; Nancy J. Flint, Esq.

(57) ABSTRACT

A system and method for securing a roof truss to a load bearing wall is disclosed. A strap is attached to a roof truss at one end and extended to the top of a load-bearing wall. A buckle is placed over the strap to secure the strap between the buckle and the roof truss, and also the buckle and the load-bearing wall. The end of the strap is extended along the top of buckle toward the roof truss and a top plate secures the strap between the buckle and the top plate. Screws are placed through holes in the top plate and corresponding holes in the buckle to attach the system to the top of the load-bearing wall. The system and method of the invention provides both horizontal (lateral) resistance and uplift resistance, thus resisting horizontal (lateral) forces while at the same time providing uplift resistance.

16 Claims, 16 Drawing Sheets

(56) References Cited

U.S. PATENT DOCUMENTS 5,207,042 A * 5/1993 Molinar ..... E04B 1/10 52/92.1
5,448,871 A * 9/1995 Newman ..... E04B 7/04 52/712
5,489,088 A * 2/1996 Warter ..... E04G 21/3233 269/904
5,870,861 A * 2/1999 Gnaedinger ..... E04B 7/04 52/DIG. 11
5,937,608 A * 8/1999 Kucirka ..... E04G 23/0218 52/693
6,219,973 B1 * 4/2001 Lafferty ..... E04B 7/02 52/93.2
6,408,592 B1 * 6/2002 Hourani ..... E04C 3/16 52/456
6,513,290 B2 * 2/2003 Leek ..... E04B 1/2604 52/297
6,684,584 B1 * 2/2004 Goldwitz ..... E04H 15/648 52/273
6,758,022 B1 * 7/2004 Coll ..... E04C 3/09 52/696
7,237,368 B2 * 7/2007 Richardson ..... E04B 1/4107 52/92.1
7,484,334 B1 * 2/2009 Oviedo-Reyes ..... E04H 9/14 52/92.1
7,832,173 B2 * 11/2010 Crawford ..... F16B 25/0057 52/690
8,215,073 B2 * 7/2012 Gorman ..... E06B 9/02 160/368.1
8,646,222 B2 * 2/2014 Carbonaro ..... E04B 1/38 52/92.1
10,745,907 B1 * 8/2020 Canby ..... E04B 1/2604
11,078,661 B2 * 8/2021 Canby ..... E04B 1/388
2004/0144039 A1 * 7/2004 Poutanen ..... E04C 3/185 52/1
2006/0133912 A1 * 6/2006 Commins ..... F16B 5/0233 411/536
2008/0282641 A1 * 11/2008 Sackett ..... E04B 7/045 52/715
2008/0283702 A1 * 11/2008 Ikerd ..... E04B 1/2604 248/228.1
2009/0025309 A1 * 1/2009 Deans ..... E04B 5/12 52/92.2
2010/0212251 A1 * 8/2010 Llorens ..... E04B 7/045 52/712
2015/0135637 A1 * 5/2015 Platts ..... E04G 23/0281 254/131.5

* cited by examiner

PRIOR ART

SYSTEM AND METHOD OF SECURING A ROOF TRUSS TO A LOAD-BEARING WALL

FIELD OF THE INVENTION

The invention relates to a system and method for securing a roof truss to a load bearing wall. A strap for securing a roof truss to a load-bearing wall is attached to the roof truss at one end and extended to the top of a load-bearing wall. A buckle is placed over the exposed surface of the strap located at the top of the load-bearing wall. The free end of the strap is wrapped around the buckle and a top plate is placed on top of the buckle, securing the strap between the buckle and the top plate. Screws are placed through holes in the flat plate and corresponding holes in the buckle to attach the system to the top of the load-bearing wall. The system and method of the invention provides both horizontal (lateral) resistance and uplift resistance, thus resisting horizontal (lateral) forces while at the same time providing uplift resistance.

BACKGROUND OF THE INVENTION

Wood structures predominate in residential and light commercial construction. When wood framing is used the structure must be protected from upward loads developed by high wind, which differs with geographical location and is enforced by different building codes for such areas. Wind uplift is created when the air pressure below the roofing system is higher than the air pressure above the roof. When the wind blows over a roof's surface, the air pressure directly above the roof decreases, causing "negative" pressure. At the same time, the wind causes air infiltration below the roof materials through openings and cracks that create a "positive" pressure. The combination of negative pressure above and positive pressure below the roofing surface materials results in a "push-pull" force working together to separate the roofing materials from the roof deck. fast-moving exterior air flows over and around the building, creating a reduced pressure, or suction. The reduced pressure is lower inside the building, which is increased by air flowing through the building openings. When the interior positive pressure is added to negative exterior pressure created by high velocity winds, "ballooning" or uplift of the membrane may occur. The differential pressures are most severe at corners and perimeters.

Wind uplift is affected by:

- Building height: Higher roofs experience stronger wind velocities.
- Geographical location: Wind maps for any region can identify the local basic wind speed gust exposures to determine typical wind conditions for your home.
- Surrounding terrain: Neighboring buildings and other obstructions can break wind flow and reduce the wind effect in suburban and urban locations. Stronger wind resistance is required for roofs near large bodies of water or open terrain.
- Building openings: Openings in the building design can create higher internal pressures in a wind event.

Roof systems are the largest exterior building component exposed to weather and the elements. The function of a roof is to protect the building's interior components from these elements. Roof system attachment is a critical element of roof design and application. Improper attachment results in the increased probability of wind blow-offs and contributes to membrane strain created by differential movement of the system components. The design and application methods must address attachment of the total system and all the components, including the substrate, roofing, flashing, metal coverings and penetrations. The most prevalent element that proper attachment will deter is damage from wind force, particularly wind uplift damage.

Modern wood roofs are mostly framed with pairs of common rafters or prefabricated wooden roof trusses fastened together with truss connector plates. In high wind areas, such as where a cyclone or hurricane may make landfall, the main engineering consideration is to hold the roof down during severe storms. This is accomplished by using metal ties (straps) that fasten each rafter or roof truss to a supporting (load-bearing) wall.

Common straps that are used today include twist metal straps such as the HTWM Series Masonry Strap by USP Structural Connectors. The twist metal strap made of 14 gauge steel is attached to either side of grouted masonry or concrete wall with 4 wedge bolts, and attached to the roof truss with 8 10d×1½ nails. The twist metal strap does not have to be wrapped over the roof truss to achieve the allowable load.

Straight straps are also used today, such as strap ties made by Simpson Strong-Tie for uplift applications. For example, MSTAM/MSTCM Strap Ties made from 18 gauge or 16 gauge steel are designed for wood-to-masonry applications. The ties are attached to the wooden roof truss using 9 to 13 to 26 nails size 0.148×3 depending on the model, and are attached to masonry or concrete with 5 to 8 to 14½×2¼ bolts, again depending on the model.

Metal brackets may also be used to tie-down a roof member such as the HGAM Hurricane Gusset Angle for Masonry made by Simpson Strong-Tie. This gusset angle secures the bottom chord of a framing member to masonry. The gusset angle is made from 14 gauge galvanized steel and attaches to wood using 1½ inch connector screws and to masonry using Titen® 2 masonry screws.

AU Patent No. 36753/78 discloses a support bracket for connecting an upper beam to a lower beam angled to it. The bracket includes a web portion, two end portions with each end portion integral with or otherwise connected to respective ends of the web portion, and each end portion having an outwardly projecting flange extending therefrom, whereby in use the web portion engages with a top face of the upper beam, each end portion engages with and extends beyond each side face of the upper beam and both of the flanges engage with a face of the lower beam.

AU Patent Appln. No. 2011202882 discloses a bracket for tie-down of a roof member, the bracket comprising a bearing portion and first and second pairs of openings which extend through the bracket, the openings of the second pair having a spacing which is greater than the spacing of the openings of the first pair, whereby the bracket can be mounted such that the bearing portion is received flat against the roof member and threaded upper ends of the rods are received through the openings of either the first pair or the second pair to receive threaded elements for effecting tight engagement between the bracket and rods and thus clamping of the roof member between the bearing portion and the structure to tie down the roof member.

DE 202014100979 discloses an angular connector for connecting two components, in particular wooden building components, comprising a cross-sectional L-shaped angle member, the L-formed by a first and a second angular element portion, each having a first and a second planar side, each vertical surface extending to the cross-section, wherein the first flat side of the angle member portions opposite each other and point towards the inside of the L-shape.

U.S. Pat. No. 4,022,537 discloses a knee brace to provide lateral resistance at the bottom of glued laminated beams and solid heavy timbers, the brace consisting of an elongated strap connected at its mid-point to the bottom of the heavy timber.

U.S. Pat. No. 4,527,375 discloses an anchor bracket for installation in newly constructed decks to resist warping or in existing decks where warping has already occurred, the bracket including a plate body portion which transversely spans abutting end portions of deck boards and a pair of depending bifurcated extensions on each end of the plate body portions which straddle the underlying support beams or joists of the deck structure.

U.S. Pat. No. 4,592,186 discloses an anchor for deck boards resting on a truss which include a deck board hold-down element, a truss-engaging resistance element and a threaded adjustable connector between the hold-down element and the resistance element.

U.S. Pat. No. 5,448,871 discloses a continuous narrow, elongated metal member bent to form a strap for holding a truss, the strap having a saddle portion to fit over the truss and two arms diverging therefrom to lie flat against the plates upon which the truss is supported.

U.S. Pat. No. 5,560,156 discloses a hurricane tie-down member formed of a unitary flat metallic preform to restrain roof trusses experiencing a high wind condition by transferring dynamic roof uplift forces from a planar saddle portion to a vertical wall via a pair of side arm members and flat anchor surfaces.

U.S. Pat. No. 6,837,019 discloses a building roof tie for attaching roof trusses and rafters to wood top plates, the roof tie having a sheet metal body with risers and a bridge for overlapping a rafter and flaps for wrapping on the sides of the top plate.

U.S. Pat. No. 7,665,253 discloses a retrofit hurricane and earthquake clip for connecting the roof to the outside wall, the metal connector including a base member with formed pockets that form tunnels, the base member further having attaching means to outside sheathing and the underlying top plate of a wall, wherein threaded rods from the roof are inserted through the tunnels of the base member and tightened together.

SUMMARY OF THE INVENTION

The invention relates to a system and method of securing a roof truss to a load bearing wall.

In one embodiment, the system comprises a strap for securing a second structural roof member, such as a roof truss, to a first structural roof member, such as a load-bearing wall. The strap is secured to the top of the second structural roof member and each free end of the arms of the strap extends downward along each vertical side of the second structural roof member to the top of the first structural roof member. Each free end of the strap is then extended horizontally along the top surface of the first structural roof member, one on each side of the second structural roof member.

In one embodiment, the system further comprises a buckle and a top plate. The end of the strap that is attached to the top of the vertical side of the second structural roof member extends down the second structural roof member and along the top surface of the first structural roof member. The buckle is placed over the free end of the strap. The free end of the strap is then extended back toward the second structural roof member over the exposed surface of the buckle, whereupon a top plate is placed on top of the strap and over the buckle such that the strap is secured between the top plate and the buckle. The top plate is then attached to the first structural roof member by suitable connectors, such as wedge bolts, nails or screws, that extend through holes in the top plate and corresponding holes in the buckle.

In one embodiment, the system comprises a strap, two (2) buckles as previously described and two (2) top plates as previously described. Each free arm of the strap extends downward along each vertical side of the second structural roof member to the top of the first structural roof member as previously described. A buckle is placed over a free end of the strap. The free end of the strap is then extended back toward the second structural roof member over the exposed surface of the buckle, whereupon a top plate is placed on top of the strap and over the buckle such that the strap is secured between the top plate and the buckle. The top plate is then attached to the first structural roof member by suitable connectors, such as wedge bolts, nails or screws, that extend through holes in the top plate and corresponding holes in the buckle. One buckle and top plate are used as described to secure the strap on either side of the second structural roof member.

The first structural roof member may comprise a load-bearing wall which comprises a top plate (if wood) or concrete (if a tie beam). The second structural roof member may comprise a roof truss.

In one embodiment, the strap is substantially flat and comprises a flat central portion and two arms disposed at a substantially 22-degree bend from the flat central portion which allows the arms of the strap to extend almost vertically straight when installed over the top of the second structural roof member. In one embodiment, the strap is substantially straight.

BRIEF DESCRIPTION OF THE DRAWINGS

The invention will be more readily understood from the following detailed description of the various aspects of the invention taken in conjunction with the accompanying drawings in which.

DETAILED DESCRIPTION OF THE INVENTION

Figure 1:
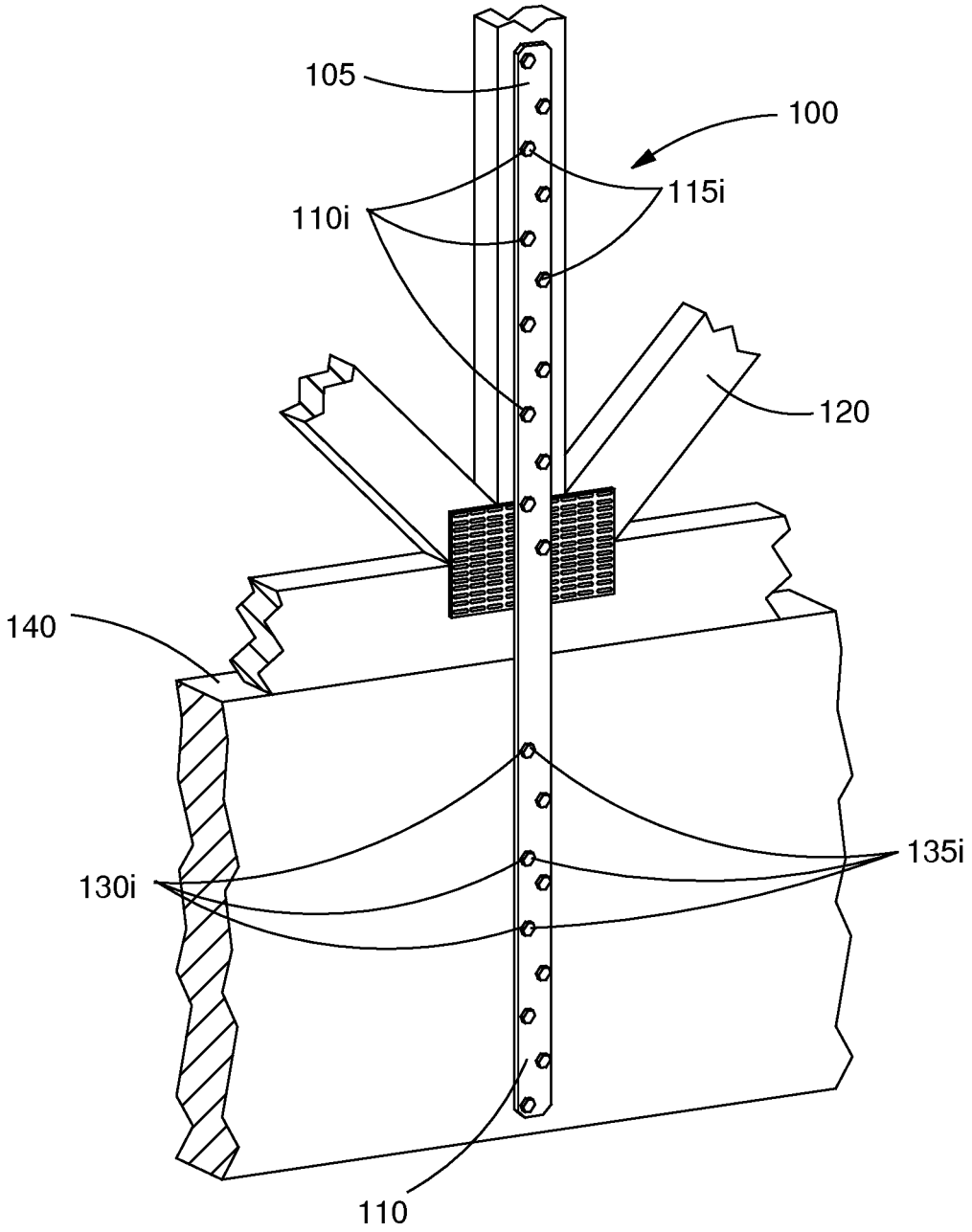
FIG. 1 depicts a side view of a straight strap as is known in the art.

The invention relates to a system and method of securing a roof truss to a load bearing wall. The strap and buckle comprising the invention when combined provide both horizontal (lateral) resistance and uplift resistance, thus resisting horizontal (lateral) forces while at the same time providing uplift resistance.

In one embodiment, the system comprises an angled strap for securing a second structural roof member, such as a roof truss, to a first structural roof member, such as a load-bearing wall. The angled strap is substantially flat and comprises a flat central portion and two arms disposed at a substantially 22-degree angle from the flat central portion which allows the angled strap to extend almost vertically straight when installed over the top of the second structural roof member. The flat central portion of the angled strap is secured to the top of the second structural roof member and each free end of the angled strap extends downward along opposing vertical sides of the second structural roof member to the top of the first structural roof member. The angled strap may comprise 14 gauge-20 gauge steel. The angled strap may be galvanized.

In one embodiment, the angled strap is approximately 1¼ inches wide and the substantially flat central portion is about 1½ inches long to fit over the top of a 2×6 wood roof truss which is approximately 1½ inch wide. Such an angled strap can be used for up to a 6/12 roof pitch. In one embodiment, the length of the substantially flat central portion is 3 inches and 3¼ inches wide to fit over the top of two standard roof trusses that have been attached to each other. In other embodiments, the length of the substantially flat portion of the angled strap and the width of the angled strap varies vary according to the size of the roof truss. In other embodiments, the angle of the arms of the angled strap and the substantially flat central portion can be greater than 22 degrees for roofs with pitch steeper than 6/12. The angled strap may comprise a plurality of holes for securing the angled strap to a roof truss, allowing for variations of the size of the roof truss.

In one embodiment, the system comprises a buckle and a top plate, where the buckle comprises a bracket with a vertical arm and a horizontal arm connected by a flat connector, where the flat connector is disposed at an angle to both the vertical arm and the horizontal arm. The vertical arm of the buckle is attached to the vertical side of a second structural roof member by inserting wedge bolts, nails, screws or other suitable connectors through predrilled holes in the vertical arm. In one embodiment, the horizontal arm of the buckle is attached to the top surface of a first structural roof member by inserting wedge bolts, nails, screws or other suitable connectors through predrilled holes in the horizontal arm. In one embodiment, the buckle and top plate are attached to the top surface of the first structural roof member by inserting wedge bolts, nails, screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws used to attach the buckle and top plate to the first structural roof member are approximately ¼" in diameter and the predrilled holes in the flat connector of the buckle are approximately 3/16" in diameter.

In one embodiment, the system comprises an angled strap, two (2) buckles as previously described and two (2) top plates as previously described. The flat central portion of the angled strap is attached to the top of the second structural roof member. Each arm of the angled strap is extended from each side of the second structural roof member to the top of a first structural roof member. A buckle is placed at each intersection of the first structural roof member, such as the top of a load-bearing wall, and each vertical side of the second structural roof member, such as the side of a roof truss, such that the horizontal arms of each buckle are placed on top of each of the extended arms of the angled strap along the horizontal top surface of the first structural roof member. The horizontal arm of each buckle is attached to the top of the first structural roof member on each side of the second structural roof member. The vertical arm of each buckle is attached to the side of the second structural roof member, securing the extended arms of the angled strap between each vertical arm of the buckle and the vertical side of the second structural roof member, and between each horizontal arm of the buckle and the horizontal top surface of the first structural roof member. The free end of each arm of the angled strap is then extended back toward the second structural roof member over the exposed surfaces of each horizontal arm of each buckle. A top plate is placed over the free end of each arm of the angled strap such that it mates with the flat connector and secures one arm of the angled strap between a top plate and a flat connector. Each top plate is then attached to the first structural roof member by connectors, such as screws, that extend through holes in each top plate and corresponding holes in each flat connector.

In one embodiment, the angled strap comprises 14 gauge-20 gauge steel. In one embodiment, the angled strap is galvanized. In one embodiment, the angled strap is approximately 1¼ inches wide and the substantially flat central portion is about 1½ inches long to fit over the top of a 2×6 wood roof truss which is approximately 1½ inch wide. Such an angled strap can be used for up to a 6/12 roof pitch. In one embodiment, the length of the substantially flat central portion is 3 inches and 3¼ inches wide to fit over the top of two standard trusses that have been attached to each other. In other embodiments, the length of the substantially flat portion of the angled strap and the width of the angled strap vary according to the size of the roof truss. In other embodiments, the angle of the arms of the angled strap and the substantially flat central portion can be greater than 22 degrees for roofs with pitch steeper than 6/12. The angled strap may comprise a plurality of holes for securing the strap to a roof truss, allowing for variations of the size of the roof truss. In one embodiment, the free ends of the first arm and second arm of the angled strap proximate the first structural roof member are solid. The absence of holes in the free ends of the first arm and the second arm of the angled strap proximate the load-bearing wall strengthens the angled strap because the angled strap has more cross-sectional area to resist tension due to uplift resistance. In one embodiment, the angled strap may comprise a plurality of holes at the free end of the arms to secure the angled strap to the top of a load-bearing wall.

In one embodiment, the vertical arm of the buckle is attached to the side of a second structural roof member by inserting screws or other suitable connectors through predrilled holes in the vertical arm. In one embodiment, the horizontal arm of the buckle is attached to the top surface of a first structural roof member by inserting screws or other suitable connectors through predrilled holes in the horizontal arm. In one embodiment, the buckle and top plate are attached to the top surface of the first structural roof member by inserting screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3/16" in diameter.

In one embodiment, the system comprises a straight strap, a buckle and a top plate as previously described. The straight strap is attached to the top of the second structural roof member and the free end of the straight strap extends to the top of a first structural roof member. A buckle is placed at the intersection of the first structural roof member, such as the top of a load-bearing wall, and the vertical side of the second structural roof member, such as the side of a roof truss, such that the horizontal arm of the buckle is placed on top of the free end of the straight strap along the horizontal top surface of the first structural roof member. The horizontal arm of the buckle is attached to the top of the first structural roof member on the side of the second structural roof member. The vertical arm of the buckle is attached to the side of the second structural roof member, securing the free end of the straight strap between the vertical arm of the buckle and the vertical side of the second structural roof member, and between the horizontal arm of the buckle and the horizontal top surface of the first structural roof member. The free end of the straight strap is then extended back toward the second structural roof member over the exposed surfaces of the horizontal arm of the buckle. A top plate is placed over the free end of the straight strap such that it mates with the flat connector and secures the free end of the straight strap between the top plate and the flat connector of the buckle. The top plate is then attached to the first structural roof member by connectors, such as screws, that extend through holes in the top plate and corresponding holes in the flat connector.

In one embodiment, the straight strap comprises 14 gauge-20 gauge steel. In one embodiment, the straight strap is galvanized. In one embodiment, the straight strap is approximately 1¼ inches wide. The straight strap may comprise a plurality of holes for securing the straight strap to a second structural roof member allowing for variations of the size of the second structural roof member. The straight strap may further comprise a plurality of holes for securing the straight strap to a first structural roof member allowing for variations of the size of the first structural roof member.

In one embodiment, the vertical arm of the buckle is attached to the side of a second structural roof member by inserting screws or other suitable connectors through predrilled holes in the vertical arm. In one embodiment, the horizontal arm of the buckle is attached to the top surface of a first structural roof member by inserting screws or other suitable connectors through predrilled holes in the horizontal arm. In one embodiment, the buckle and top plate are attached to the top surface of the first structural roof member by inserting screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3/16" in diameter.

In one embodiment, the buckle and/or the top plate are fastened to the first structural roof member using tap-cons. In one embodiment, the extended arm of the straight strap is secured between the top of the first structural roof member and the horizontal arm of a single buckle. In one embodiment, one or more nails are placed in the free end of the first arm and second arm of the straight strap, preventing the straight strap from slipping through the buckles and/or flat plate.

In one embodiment, the system comprises a strap, a buckle and a top plate, where the buckle comprises a bracket having a horizontal arm and an angled arm. One end of the strap is attached to the top of the vertical side of the second structural roof member and the free end of the strap is extended down the second structural roof member. Prior to the intersection of the first structural roof member and the second structural roof member, the strap is bent to a first angle of approximately 135 degrees downward in the direction of the first structural roof member. The strap extends for a distance, and then the strap is bent to a second angle of approximately 135 degrees such that the strap extends along the top surface of the first structural roof member. The angled arm of the buckle is placed atop the portion of the strap between the first angle and the second angle, and the horizontal arm of the buckle is placed atop the portion of the strap that extends along the top surface of the first structural roof member. The top plate is placed atop the angled arm of the buckle. The angled arm and horizontal arm of the buckle are attached to the top surface of the first structural roof member. The free end of the strap is extended back toward the second structural roof member over the exposed surface of the horizontal arm of the buckle, whereupon the top plate is placed on the angled arm. The top plate is attached to the top surface of the first structural roof member such that it secures the free end of the strap between the top plate and the angled arm.

In one embodiment, the straight strap comprises 14 gauge-20 gauge steel. In one embodiment, the strap is galvanized. In one embodiment, the strap is approximately 1¼ inches wide. The strap may comprise a plurality of holes for securing the strap to a second structural roof member allowing for variations of the size of the second structural roof member. The strap may further comprise a plurality of holes for securing the strap to a first structural roof member allowing for variations of the size of the first structural roof member.

In one embodiment, the horizontal arm and the angled arm of the buckle are attached to the top surface of a first structural roof member by inserting screws or other suitable connectors through predrilled holes in the horizontal arm and the angled arm. In one embodiment, the buckle and top plate are attached to the top surface of the first structural roof member by inserting screws or other suitable connectors through predrilled holes in each of the horizontal arm, the angled arm and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3/16" in diameter.

In one embodiment, the buckle and/or the top plate are fastened to the first structural roof member using tap-cons. In one embodiment, the extended arm of the strap is secured between the top of the first structural roof member and the horizontal arm of the buckle. In one embodiment, one or more nails are placed in the free end of the strap, preventing the strap from slipping through the buckle and/or top plate.

In one embodiment, the system comprises a strap, a buckle and a top plate, where the buckle comprises a vertical arm, an angled arm and a horizontal arm. One end of the strap is attached to the top of the vertical side of the second structural roof member and the free end of the strap is extended down the second structural roof member and along the top surface of the first structural roof member. The buckle is placed at the intersection of the first structural roof member and the vertical side of the second structural roof member such that the free end of the strap is secured between the vertical arm of the buckle and the vertical side of the second structural roof member, and also is secured between the horizontal arm of the buckle and the top of the first structural roof member. The free end of the strap is then placed along the top surface of the angled arm of the buckle, and the top plate is placed atop the angled arm of the buckle, securing the strap between the angled arm of the buckle and the top plate.

In one embodiment, the strap comprises 14 gauge-20 gauge steel. In one embodiment, the strap is galvanized. In one embodiment, the strap is approximately 1¼ inches wide. The strap may comprise a plurality of holes for securing the strap to a second structural roof member allowing for variations of the size of the second structural roof member. The strap may further comprise a plurality of holes for securing the straight strap to a first structural roof member allowing for variations of the size of the first structural roof member.

In one embodiment, the vertical arm of the buckle is attached to the side of a second structural roof member by inserting screws or other suitable connectors through predrilled holes in the vertical arm. In one embodiment, the buckle and top plate are attached to the top surface of the first structural roof member by inserting screws or other suitable connectors through predrilled holes in each of the angled arm and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3/16" in diameter.

In one embodiment, the buckle and/or the top plate are fastened to the first structural roof member using tap-cons. In one embodiment, the free arm of the strap is secured between the top of the first structural roof member and the horizontal arm of the buckle. In one embodiment, one or more nails are placed in the free end of the first arm and second arm of the strap, preventing the strap from slipping through the buckles and/or flat plate.

The first structural roof member may comprise a load-bearing wall which comprises a top plate (if wood) or concrete (if a tie beam). The second structural roof member may comprise a roof truss.

Turning to the figures, FIG. 1 depicts a side view of a straight strap as is known in the art. Straight strap 100 comprises a first end 105 and a free end 110. First end 105 comprises a plurality of holes 110*i* through which a plurality of nails or other suitable connectors $\mathbf{115}_i$ are inserted to attach first end 105 to a second structural roof member, such as a roof truss 120. Free end 110 comprises a plurality of holes $\mathbf{130}_i$ through which a plurality of wedge bolts or other suitable connectors $\mathbf{135}_i$ are inserted to attach free end 110 to the top of a first structural roof member, such as a load-bearing wall 140.

Figure 2:
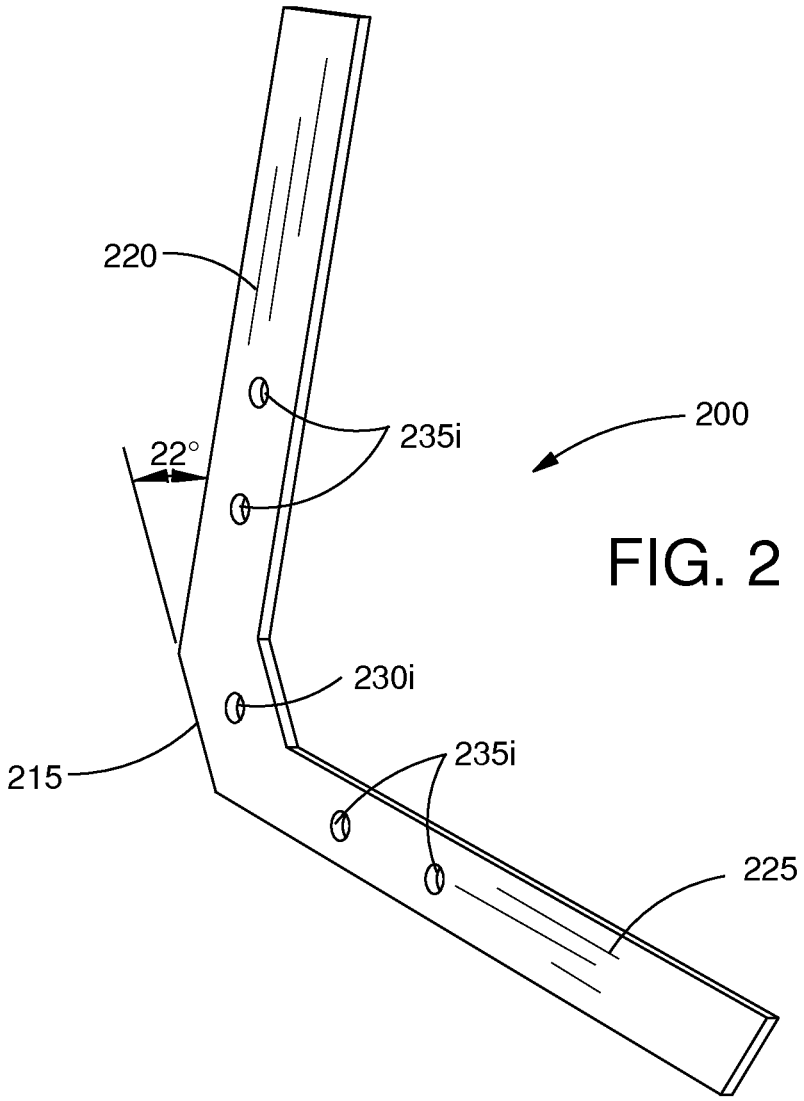
FIG. 2 depicts a perspective view of an angled strap according to one embodiment of the invention.

FIG. 2 depicts a perspective view of an angled strap 200 according to one embodiment of the invention. Angled strap 200 comprises a flat central portion 215, and a first arm 220 and a second arm 225 disposed at a substantially 22-degree angle from flat central portion 215. This angle allows angled strap 200 to extend almost vertically straight when installed over the top of a second structural roof member, such as a roof truss. Flat central portion 215 of angled strap 200 comprises one or more holes $\mathbf{230}_i$ through which wedge bolts, nails, screws or other suitable connectors are inserted to secure angled strap 200 to the top of a second structural roof member, such as a roof truss. First arm 220 and second arm 225 each comprise a plurality of holes $\mathbf{235}_i$ through which wedge bolts, screws, nails or other suitable connectors are inserted to secure angled strap 200 to the vertical side of a first structural roof member, such as a load-bearing wall.

Figure 3:
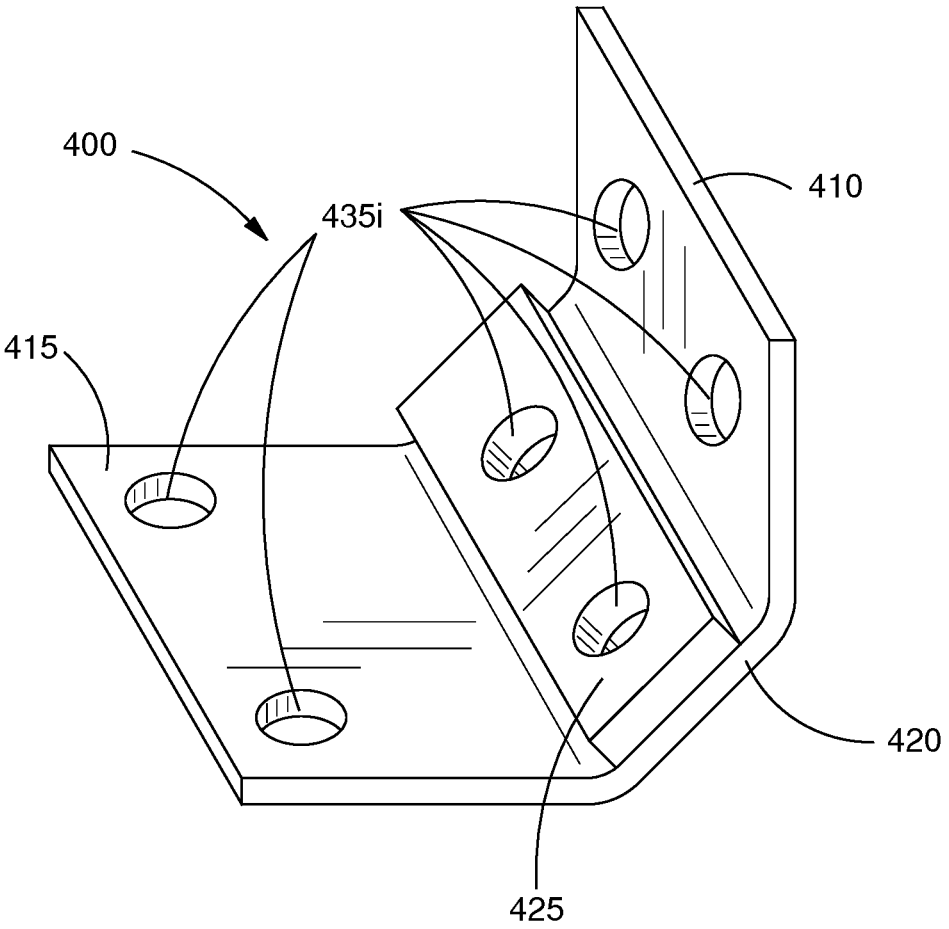
FIGS. 3 and 4 depict a buckle according to one embodiment of the invention.
Figure 4:
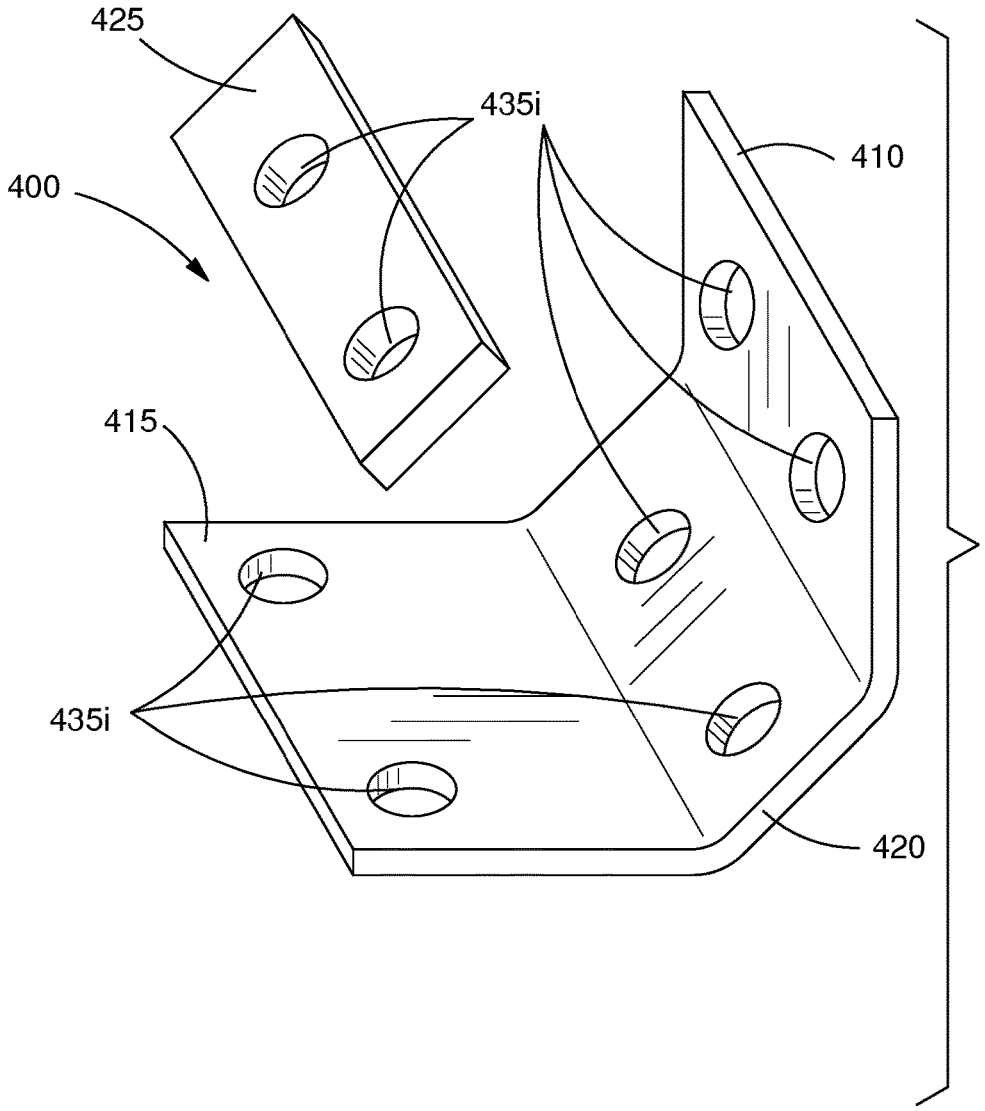

FIGS. 3 and 4 depict a buckle 400 according to one embodiment of the invention. Buckle 400 comprises a vertical arm 410 and a horizontal arm 415. Vertical arm 410 and horizontal arm 415 are connected by a flat connector 420, which is disposed at an angle to each of vertical arm 410 and horizontal arm 415. A top plate 425 is sized to mate with the top surface of flat connector 420. Holes $\mathbf{435}_i$ are disposed in vertical arm 410, horizontal arm 415, flat connector 420 and top plate 425 to attach buckle 400 to a second structural roof member, such as a roof truss, to a first structural roof member, such as a load-bearing wall.

Figure 5:
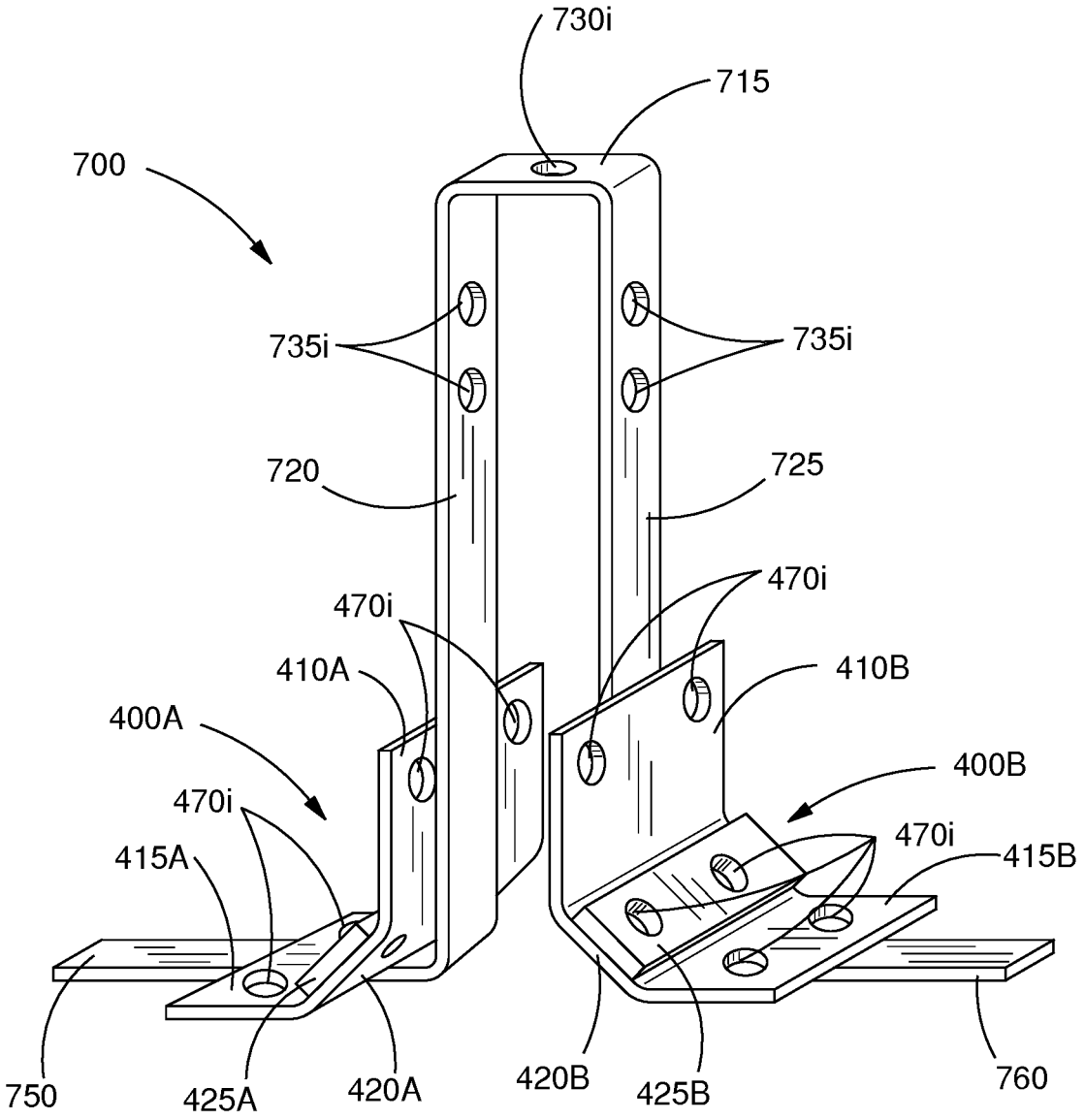
FIGS. 5 and 6 depict a system comprising an angled strap and two buckles to secure a roof truss to the top surface of a load-bearing wall according to one embodiment of the invention.
Figure 6:
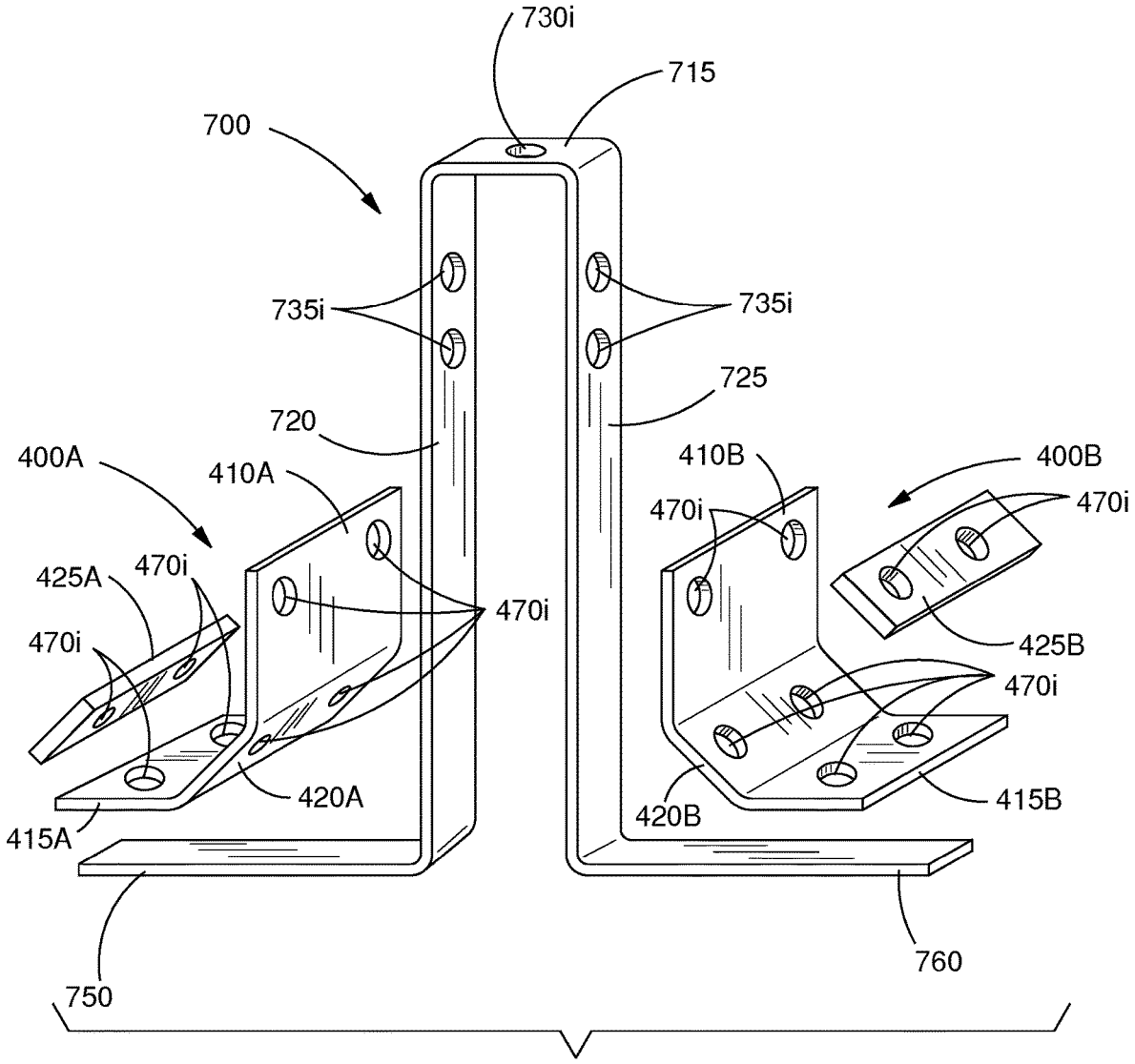

FIGS. 5 and 6 depict a system comprising angled strap 700 and two buckles 400A, 400B according to one embodiment of the invention for securing a second structural roof member, such as a roof truss, to a first structural roof member, such as a load-bearing wall. Angled strap 700 comprises a flat central portion 715, a first arm 720 having a first free end 750 and a second arm 725 having a second free end 760, where each of first arm 720 and second arm 725 are disposed at a substantially 22-degree angle from flat central portion 715 as seen in FIG. 2. This angle allows angled strap 700 to extend almost vertically straight when installed over the top of a second structural roof member, such as a roof truss. Flat central portion 715 of angled strap 700 comprises one or more holes $\mathbf{730}_i$ through which wedge bolts, nails, screws or other suitable connectors are inserted to secure angled strap 700 to the top of the second structural roof member, such as a roof truss. First arm 720 and second arm 725 of angled strap 700 each comprise one or more holes $\mathbf{730}_i$ through which wedge bolts, nails, screws or other suitable connectors are inserted to secure angled strap 700 to the vertical side of a second structural roof member, such as a roof truss. Buckles 400A, 400B each comprise a vertical arm 410A, 410B and a horizontal arm 415A, 415B. Vertical arms 410A, 410B and horizontal arms 415A, 415B are each connected by a flat connector 420A, 420B, respectively, which is disposed at an angle to each of vertical arm 410A, 410B and horizontal arm 415A, 415B. Top plates 425A, 425B are sized to mate with flat connectors 420A, 420B. Vertical arms 410A, 410B, horizontal arms 415A, 415B, flat connectors 420A, 420B and top plates 425A, 425B each comprise a plurality of holes $470_i$ through which connectors $475_i$ can be inserted to attached buckles 400A, 400B to a second structural roof member, such as a roof truss, and a first structural roof member, such as a load-bearing wall.

Figure 7:
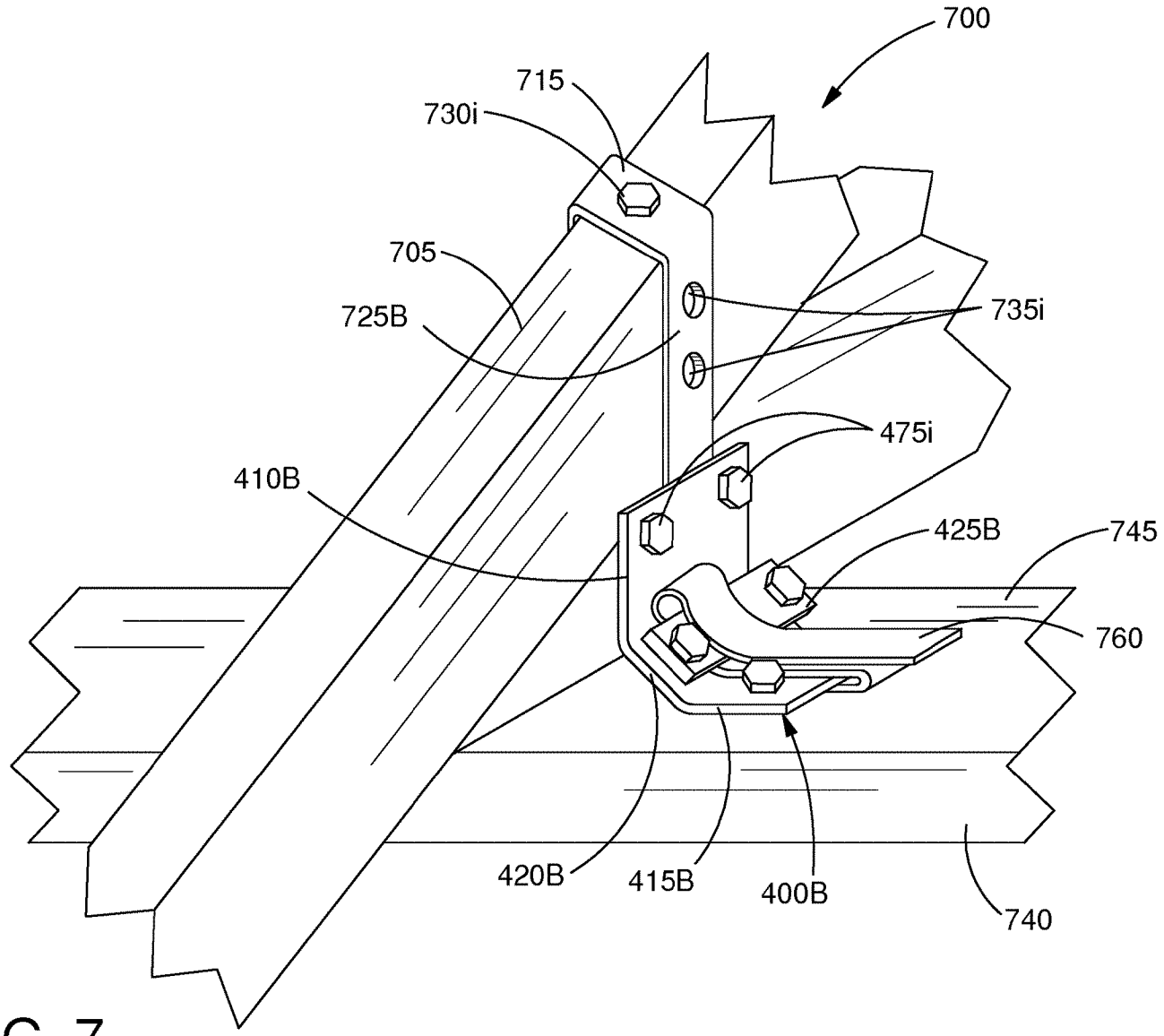
FIG. 7 depicts the system of FIGS. 5 and 6 as used to secure an angled strap to the top of load-bearing wall and to a roof truss according to one embodiment of the invention.

FIG. 7 depicts the system of FIGS. 5 and 6 as used to secure angled strap 700 to a first structural roof member, such as the top of a load-bearing wall 740, and a second structural roof member, such as a roof truss 705, according to one embodiment of the invention. In FIG. 7, only one side of roof truss 705 is shown as attached to load-bearing wall 740 using second arm 725B, second buckle 400B and second top plate 425B. First arm 720A, first buckle 400A and first top plate 425A are used in the identical manner to attach the side not shown of roof truss 705 to the top of load-bearing wall 740. In FIG. 7, second arm 725B of angled strap 700 extends vertically downward along a vertical side of roof truss 705 whereupon second free end 760 of second arm 725B of angled strap 700 is bent at substantially a right angle to extend along the top surface 745 of load-bearing wall 740. Buckle 400B is placed over second free end 760 of second arm 725B of angled strap 700. Buckle 400B is attached to the vertical side of roof truss 705 and horizontal arm 415B of buckle 400B is attached to top surface 745 of load-bearing wall 740 by placing connectors $475_i$ through holes $470_i$ in vertical arm 410B and horizontal arm 415B, securing second free end 760 of second arm 725B of angled strap 700 between the vertical side of roof truss 705 and the top of load-bearing wall 745. Second free end 760 of second arm 760 of angled strap 700 is extended back over the exposed top surface of horizontal arm 415B toward the vertical surface of roof truss 705, whereupon top plate 425B is placed over flat connector 420B such that second free end 760 of second arm 725 of angled strap 700 is secured between top plate 425B and flat connector 420B. Top plate 425B and flat connector 420B are then attached to the top surface of load-bearing wall 745 by suitable connectors $475_i$, such as wedge bolts, nails or screws, that extend through holes $470_i$ in top plate 425B and flat connector 420B.

Figure 8:
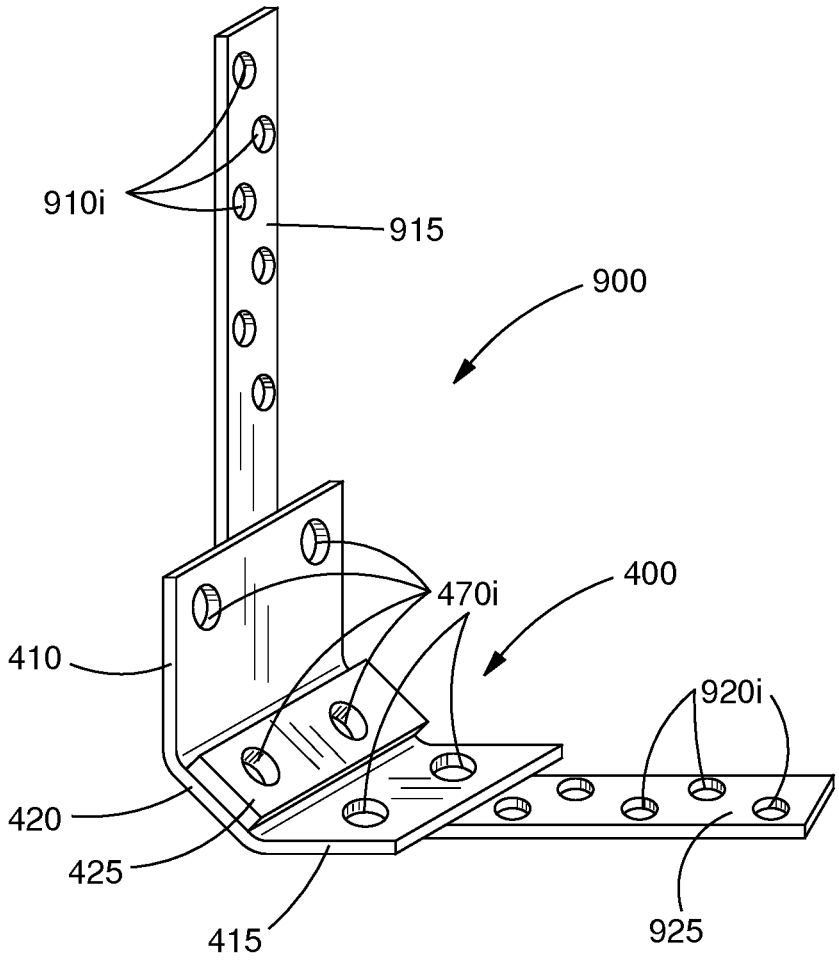
FIGS. 8 and 9 depict a system comprising a straight strap and a buckle according to one embodiment of the invention for securing a roof truss to the top of a load-bearing wall.
Figure 9:
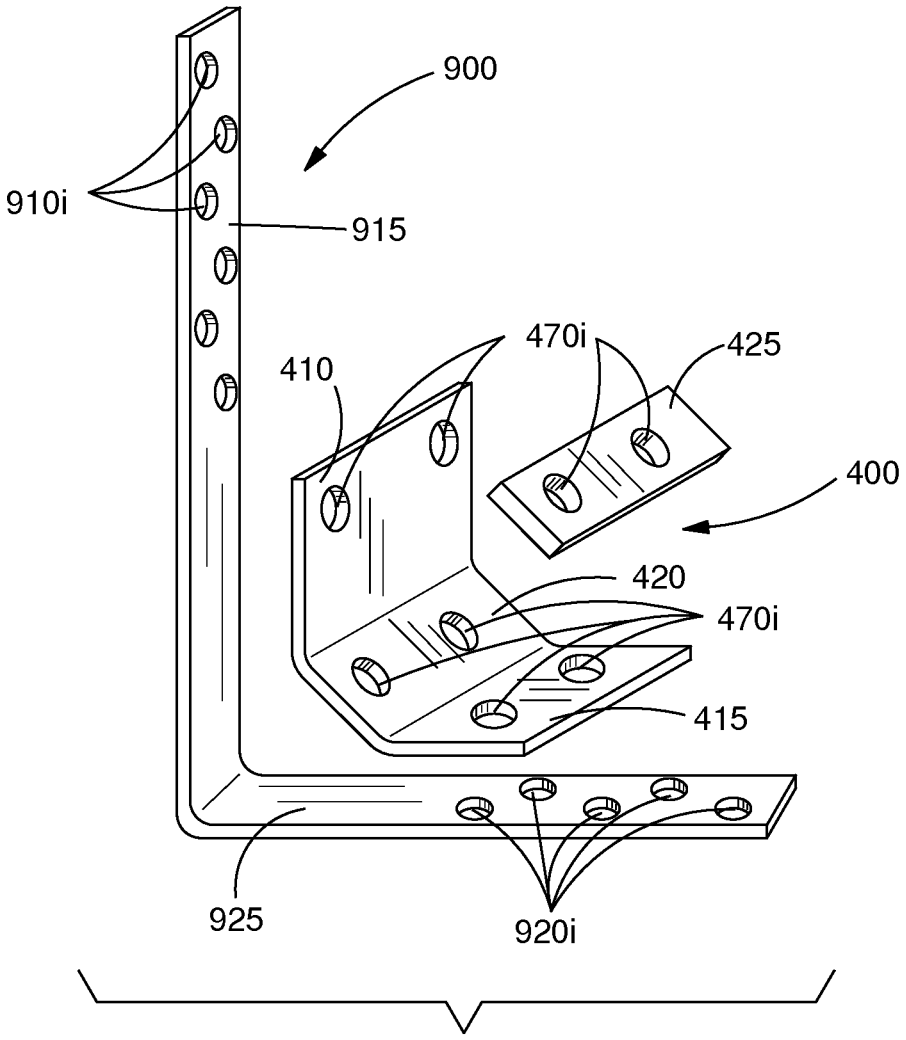

FIGS. 8 and 9 depict a system comprising a straight strap 900 and a buckle 400 according to one embodiment of the invention for securing a second structural roof member, such as a roof truss, to a first structural roof member, such as a load-bearing wall. Straight strap 900 comprises a plurality of holes $910_i$ at first end 915 and a plurality of holes $920_i$ at second end 925. Buckle 400 comprises a vertical arm 410 and a horizontal arm 415. Vertical arm 410 and horizontal arm 415 are connected by flat connector 420, which is disposed at an angle to each of vertical arm 410 and horizontal arm 415. A top plate 425 is sized to substantially mate with flat connector 420. Vertical arm 410, horizontal arm 415, flat connector 420 and top plate 425 each include a plurality of holes $470_i$ through which suitable connectors, such as wedge bolts, nails and screws, can be inserted to attach a second structural roof member, such as a roof truss, to a first structural roof member, such as a load-bearing wall.

Figure 10:
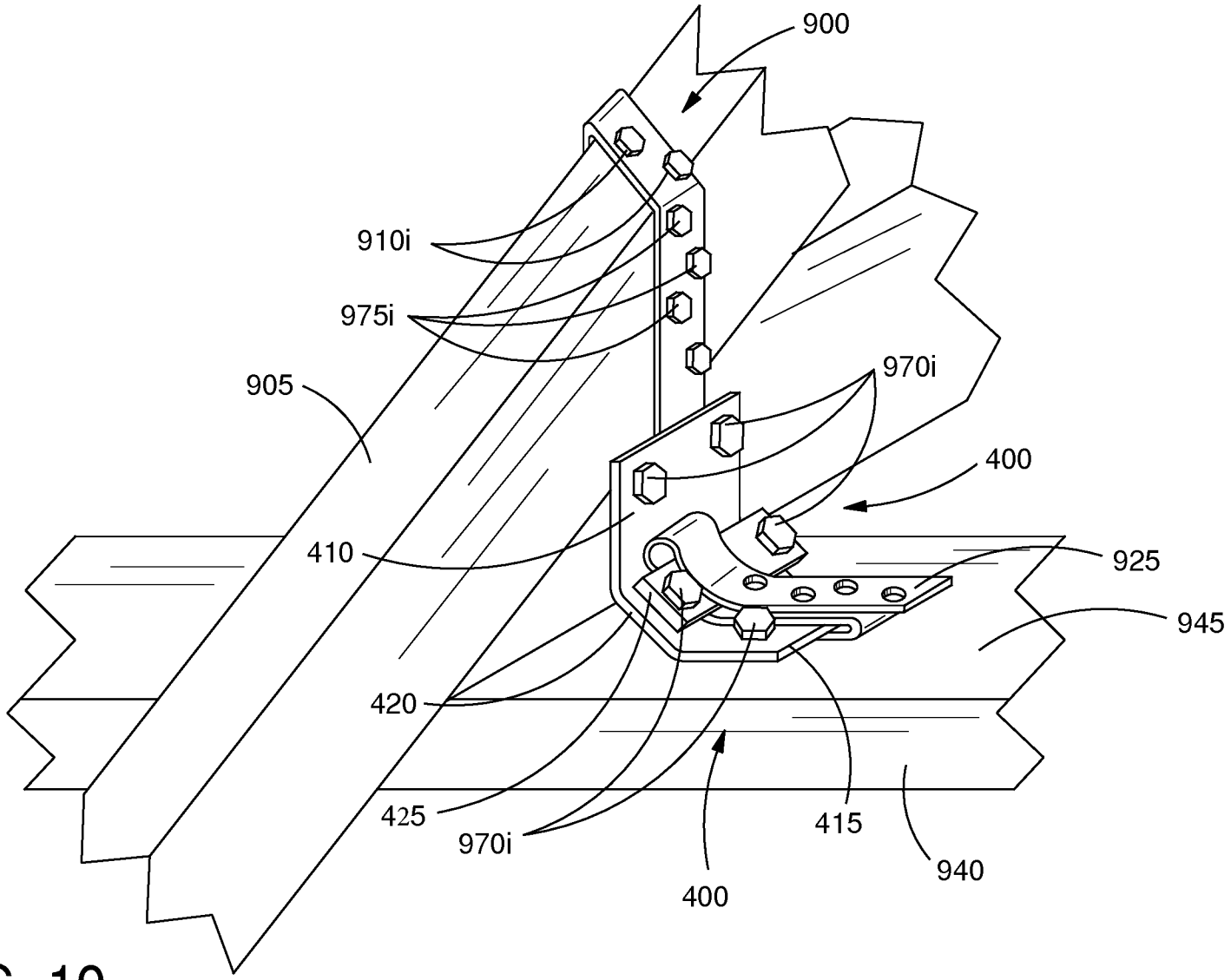
FIG. 10 depicts the system of FIGS. 8 and 9 as used to secure a roof truss to the top of a load-bearing wall according to one embodiment of the invention.

FIG. 10 depicts buckle 400 and top plate 425 as used to secure a second structural roof member, such as roof truss 905, to a first structural roof member, such as load-bearing wall 940, according to one embodiment of the invention. Straight strap 900 is attached to a vertical side of roof truss 905 by connectors $975_i$ inserted through plurality of holes $910_i$ at first end 915. Free end 925 extends vertically downward along the vertical side of roof truss 905 whereupon free end 925 of straight strap 900 is bent at substantially a right angle to then extend along the top surface 945 of load-bearing wall 940. Vertical arm 410 of buckle 400 is placed over free end 925 of straight strap 900 and horizontal arm 415 of buckle 400 is placed over free end 925 of straight strap 900. Vertical arm 410 of buckle 400 is attached to the vertical surface of roof truss 905 and horizontal arm 415 of buckle 400 is attached to top surface 945 of load-bearing wall 940, securing free end 925 of straight strap 900. Free end 925 of straight strap 900 is extended back toward the vertical side of roof truss 905, whereupon top plate 425 is placed on flat connector 420 such that free end 925 of straight strap 900 is secured between top plate 425 and flat connector 420. Top plate 425 is then attached to the top surface 945 of load-bearing wall 940 by suitable connectors $970_i$, such as wedge bolts, nails or screws, that extend through plurality of holes $470_i$ in top plate 425 and in flat connector 420.

Figure 11:
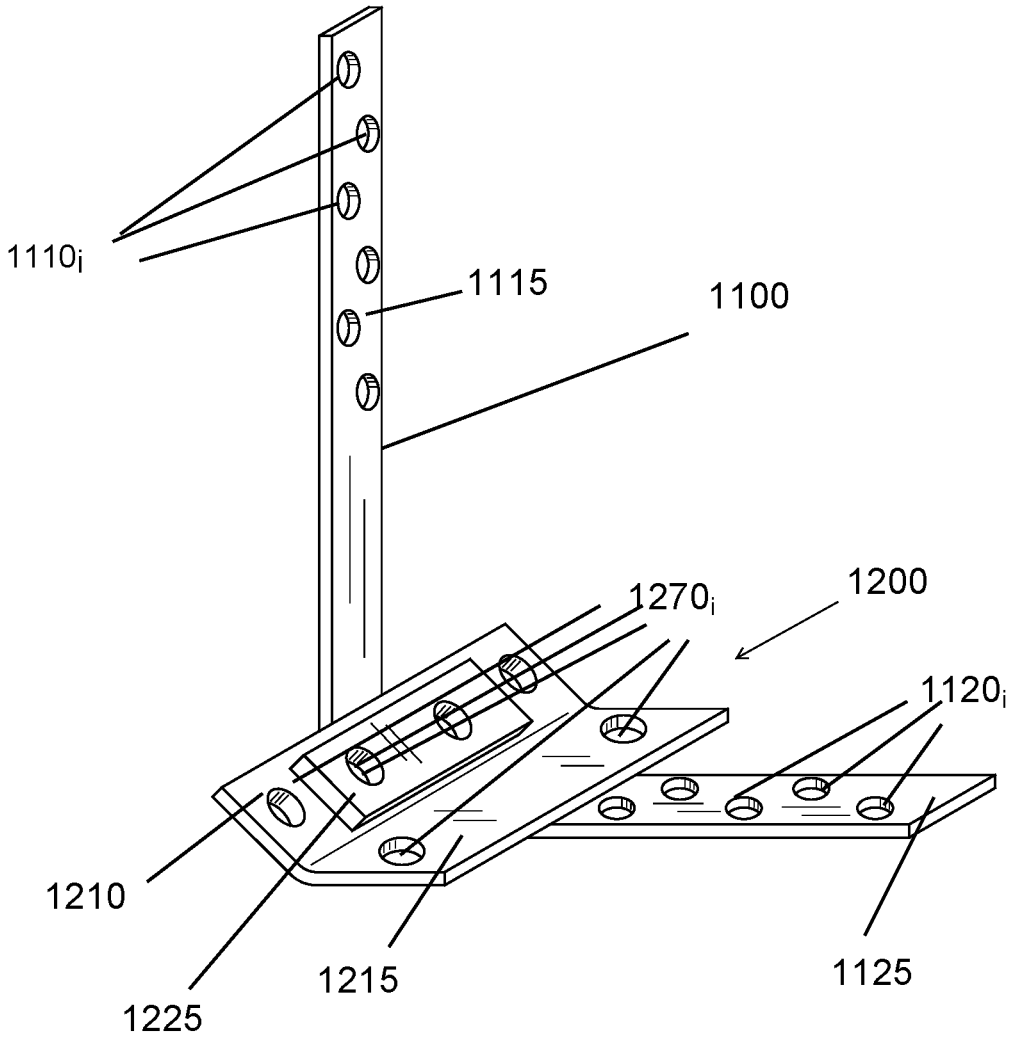
FIGS. 11 and 12 depict a system comprising a strap and a buckle according to one embodiment of the invention for securing a roof truss to the top of a load-bearing wall.
Figure 12:
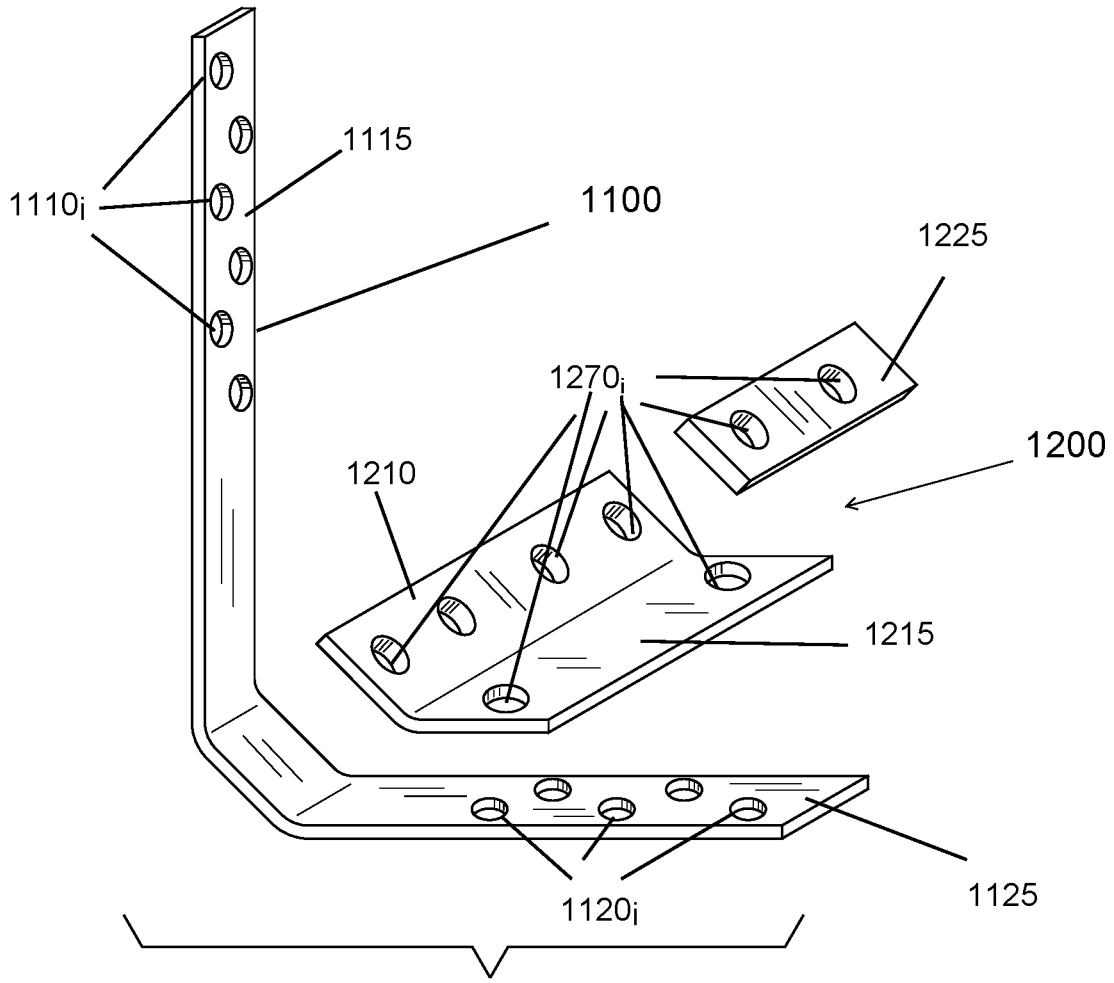

FIGS. 11 and 12 depict a system comprising a strap 1100 and a buckle 1200 according to one embodiment of the invention for securing a second structural roof member, such as a roof truss, to a first structural roof member, such as a load-bearing wall. Strap 1100 comprises a plurality of holes $1110_i$ at first end 1115 and a plurality of holes $1120_i$ at second end 1125. Buckle 1200 comprises an angled arm 1210 and a horizontal arm 1215. Angled arm 1210 and horizontal arm 1215 are disposed at an obtuse angle of approximately 135 degrees to each other. A top plate 1225 is sized to substantially mate with angled arm 1210. Angled arm 1210, horizontal arm 1215 and top plate 1225 each include a plurality of holes $1270_i$ through which suitable connectors, such as wedge bolts, nails and screws, can be inserted to attach the second structural roof member, such as a roof truss, to the first structural roof member, such as a load-bearing wall.

Figure 13:
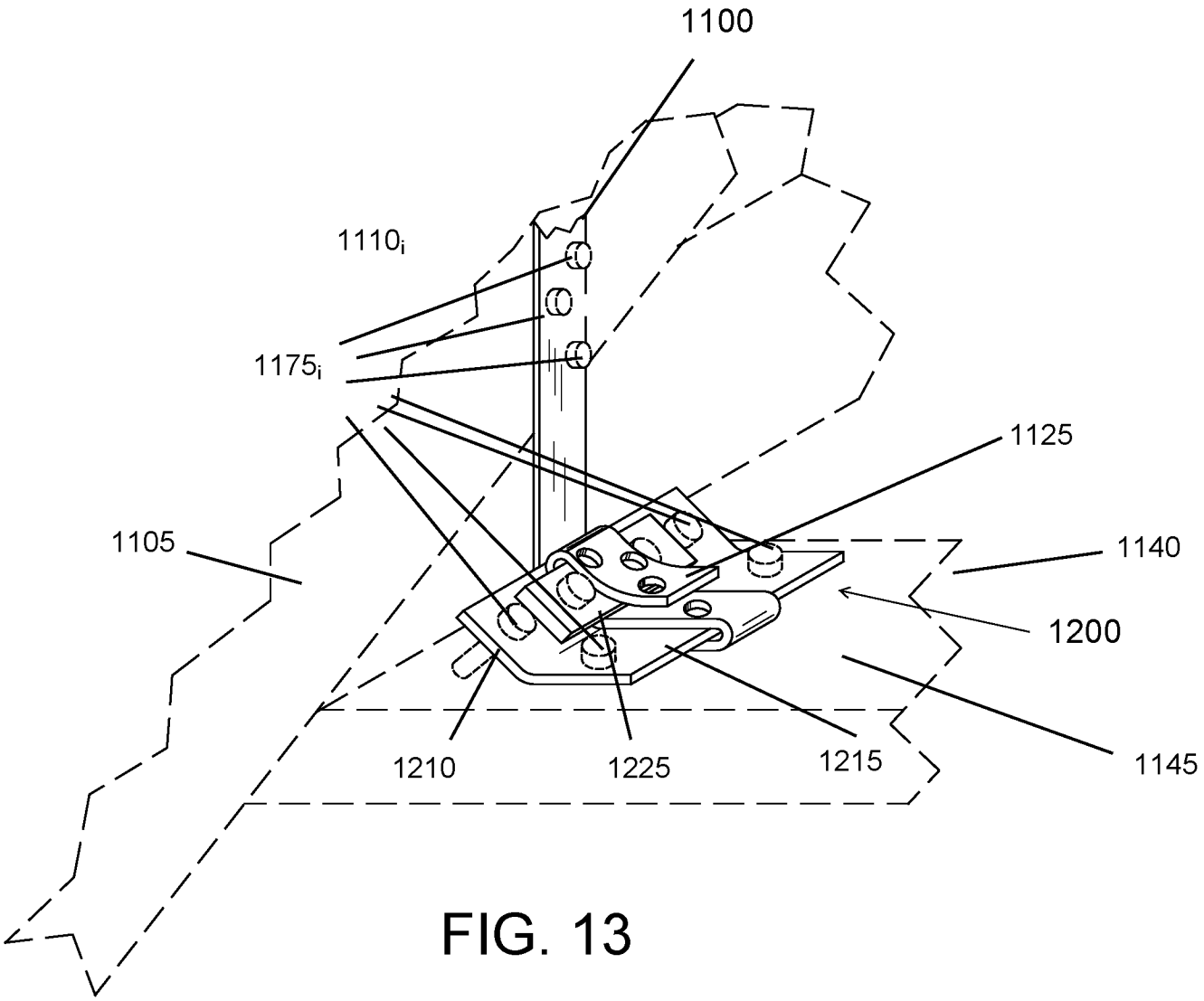
FIG. 13 depicts the system of FIGS. 11 and 12 as used to secure a roof truss to the top of a load-bearing wall according to one embodiment of the invention.

FIG. 13 depicts the system of FIGS. 11 and 12 as used to secure a roof truss to the top of a load-bearing wall according to one embodiment of the invention. Buckle 1200 and top plate 1225 secure a second structural roof member, such as roof truss 1105, to a first structural roof member, such as load-bearing wall 1140, according to one embodiment of the invention. Strap 1100 is attached to a vertical side of roof truss 1105 by connectors $1175_i$ inserted through plurality of holes $1110_i$ at first end 1115. Free end 1125 extends vertically downward along the vertical side of roof truss 1105. Prior to the intersection of roof truss 1105 and load-bearing wall 1140, strap 1100 is bent to a first angle of approximately 135 degrees downward in the direction of load-bearing wall 1140. Strap 1100 extends for a distance, and then strap 1100 is bent to a second angle of approximately 135 degrees such that strap 1100 extends along top surface 1145 of load-bearing wall 1140. Angled arm 1210 of buckle 1200 is placed over free end 1125 of strap 1100 and horizontal arm 1215 of buckle 1200 is placed over free end 1125 of strap 1100. Angled arm 1210 of buckle 1200 and horizontal arm 1215 of buckle 1200 are attached to top surface 1145 of load-bearing wall 1140, securing free end 1125 of strap 1100. Free end 1125 of strap 1100 is extended back toward the vertical side of roof truss 1105, whereupon top plate 1225 is placed on angled arm 1210 such that free end 1125 of strap 1100 is secured between top plate 1225 and angled arm 1210. Top plate 1225 is then attached to top surface 1145 of load-bearing wall 1140 by suitable connectors $1175_i$, such as wedge bolts, nails or screws, that extend through plurality of holes $1170_i$ in top plate 1225 and in angled arm 1210.

Figure 14:
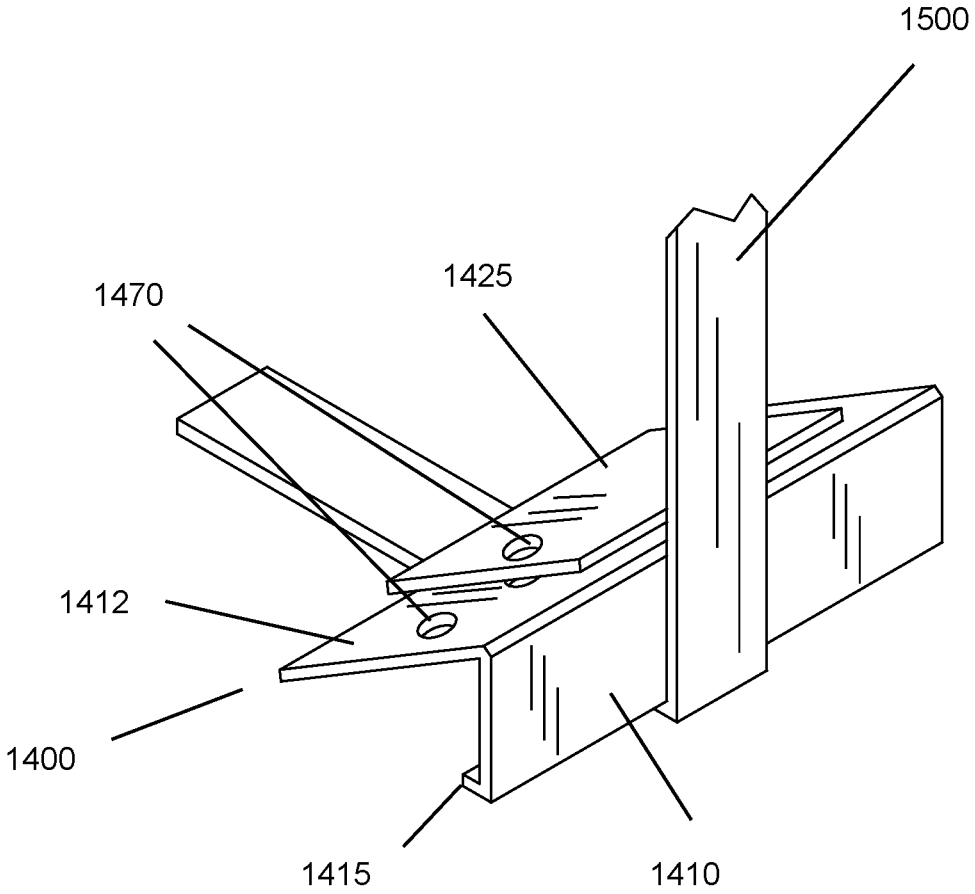
FIGS. 14 and 15 depict a system comprising a strap and a buckle according to one embodiment of the invention for securing a roof truss to the top of a load-bearing wall.
Figure 15:
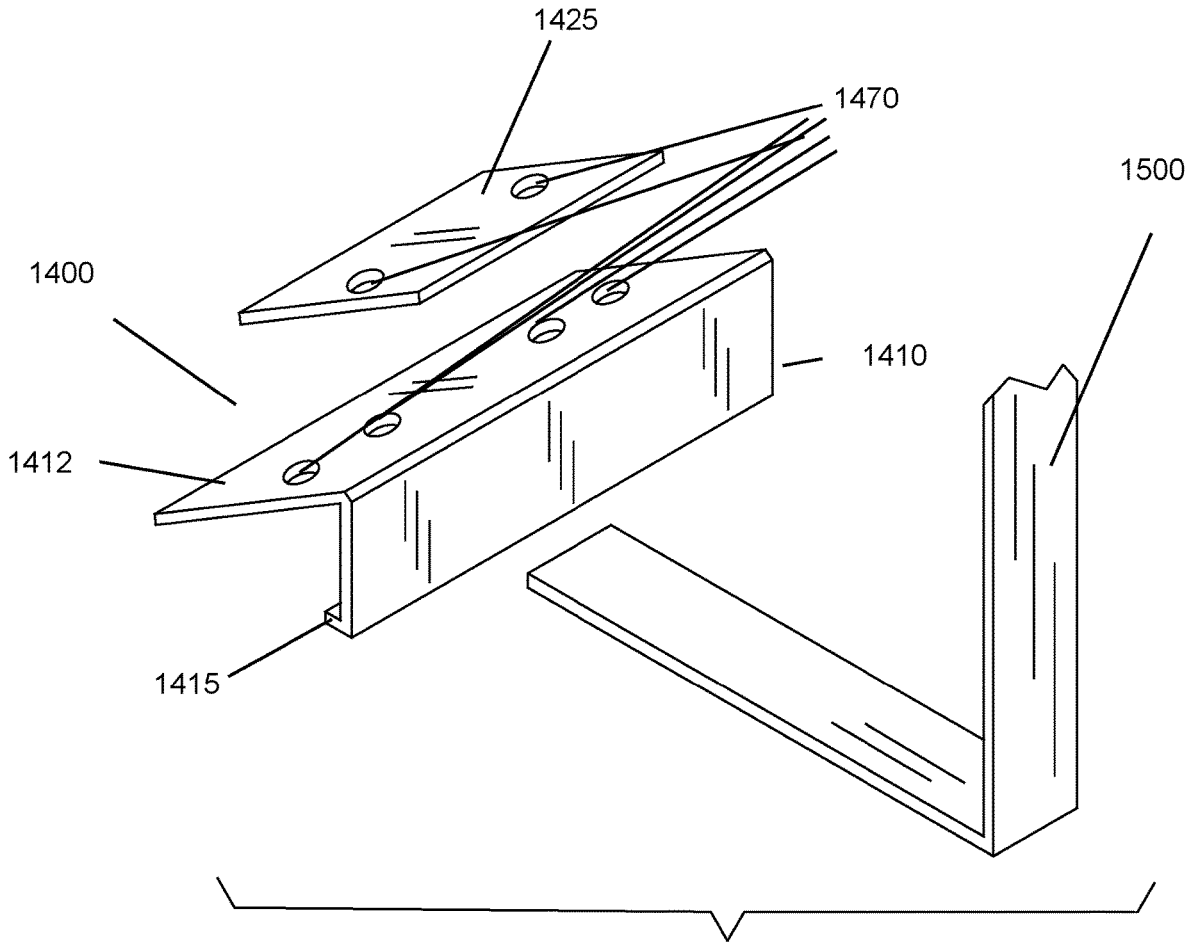

FIGS. 14 and 15 depict a system comprising a strap 1500 and a buckle 1400 according to one embodiment of the invention for securing a roof truss to the top of a load-bearing wall. Buckle 1400 comprises a vertical arm 1410, an angled arm 1412 and a horizontal arm 1415. Top plate 1425 is sized to substantially mate with angled arm 1412. Vertical arm 1410, angled arm 1412, horizontal arm 1415 and top plate 1425 each include a plurality of holes $\mathbf{1470}_i$ through which suitable connectors, such as wedge bolts, nails and screws, can be inserted to attach a second structural roof member, such as a roof truss, to a first structural roof member, such as a load-bearing wall.

Figure 16:
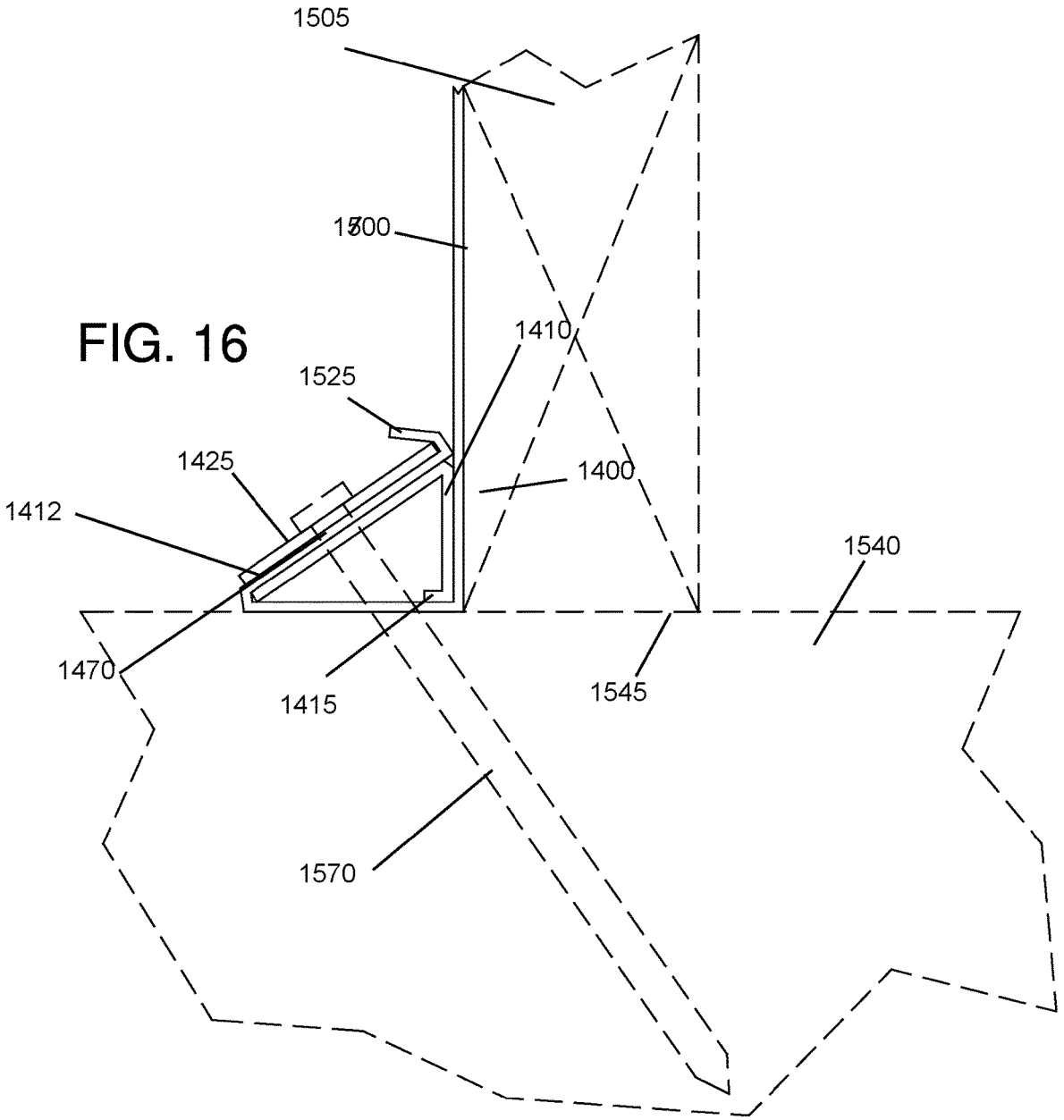
FIG. 16 depicts the system of FIGS. 14 and 15 as used to secure a roof truss to the top of a load-bearing wall according to one embodiment of the invention.

FIG. 16 depicts buckle 1400 and top plate 1425 as used to secure a second structural roof member, such as roof truss 1505, to a first structural roof member, such as load-bearing wall 1540, according to one embodiment of the invention. Strap 1500 may be attached to a vertical side of roof truss 1505 by any means desired by the user. Free end 1525 of strap 1500 extends vertically downward along the vertical side of roof truss 1505 whereupon free end 1525 of strap 1500 is bent at substantially a right angle to then extend along the top surface 1545 of load-bearing wall 1540. Vertical arm 1410 of buckle 1400 is placed over free end 1525 of straight strap 1500 and horizontal arm 1415 of buckle 1400 is placed over free end 1525 of straight strap 1500. Vertical arm 1410 of buckle 1400 is attached to the vertical surface of roof truss 1505 by any means desired by the user, securing free end 1525 of straight strap 1500. Free end 1525 of strap 1500 is extended back toward the vertical side of roof truss 1505 along the top surface of angled arm 1412, whereupon top plate 1425 is placed on angled arm 1412 such that free end 1525 of straight strap 1500 is secured between top plate 1425 and angled arm 1412. Top plate 1425 is then attached to the top surface 1545 of load-bearing wall 1540 by suitable connectors $\mathbf{1570}_i$, such as wedge bolts, nails or screws, that extend through plurality of holes $\mathbf{1470}_i$ in top plate 1425 and in angled arm 1412.

The foregoing description of various embodiments of the invention has been presented for purposes of illustration and description. It is not intended to be exhaustive or to limit the invention to the precise form disclosed and, obviously, many modifications and variations are possible. While the invention has been described in terms of a roof truss and a load-bearing wall, the invention is not limited to such a purpose. Modifications and variations that may be apparent to a person skilled in the art are intended to be included within the scope of the invention as defined by the accompanying claims.

What is claimed is:

1. A system for securing a first structural roof member to a second structural roof member, comprising:

a strap having an upper end and a lower end;

a buckle, and a top plate, wherein the upper end of the strap is secured to a vertical side of a second structural roof member;

wherein the lower end of the strap is secured between a top surface of a first structural roof member and a bottom surface of the buckle;

wherein thereafter the lower end of the strap is further secured between a bottom surface of the top plate and a top surface of the buckle, wherein the buckle and top plate are secured to the first structural roof member with one or more connectors.

2. The system of claim 1, wherein the buckle comprises a top element and a bottom element, wherein the top element comprises an angled arm, wherein the bottom element comprises a horizontal arm, wherein a top surface of the angled arm is disposed at approximately 135 degrees to a top surface of the horizontal arm, wherein the lower end of the strap is secured between a bottom surface of the horizontal arm, wherein thereafter the lower end of the strap is secured between the top surface of the angled arm and the bottom surface of the top plate.

3. The system of claim 1, wherein the buckle comprises a first element, a second element and a third element, wherein the first element comprises a vertical arm, wherein the second element comprises an angled arm and wherein the third element comprises a horizontal arm, wherein the lower end of the strap is secured between the vertical arm of the buckle and vertical side of the second structural roof member, wherein thereafter the lower end of the strap is secured between a bottom surface of the horizontal arm, wherein thereafter the lower end of the strap is secured between a top surface of the angled arm and the bottom surface of the top plate.

4. The system of claim 1, wherein the strap is galvanized.

5. The system of claim 1, wherein the strap is a straight strap.

6. The system of claim 1, wherein the first structural roof member comprises a load-bearing wall and the second structural roof member comprises a roof truss.

7. The system of claim 6, wherein the first structural roof member comprises a wooden top plate or a concrete tie beam.

8. The system of claim 1, wherein the connectors comprise wedge bolts, nails, screws or combinations thereof.

9. A method of securing a first structural roof member to a second structural roof member, comprising:

attaching an upper end of a strap to a vertical side of a second structural roof member, the strap comprising an upper end and a distal end;

extending the distal end of the strap downward along the vertical side of the second structural roof member and thereafter extending the distal end of the strap horizontally along a top surface of a first structural roof member;

disposing a bottom surface of a buckle atop a top surface of the distal end of the strap;

thereafter extending the distal end of the strap along a top surface of the buckle;

disposing a top plate along the top surface of the buckle, wherein the distal end of the strap is secured between a bottom surface of the top plate and the top surface of the buckle; and thereafter connecting the top plate and buckle to the top surface of the first structural roof member.

10. The method of claim 9, wherein the buckle comprises a top element and a bottom element, wherein the top element of the buckle comprises an angled arm, wherein the bottom element of the buckle comprises a horizontal arm, wherein a top surface of the angled arm is disposed at approximately 135 degrees to a top surface of the horizontal arm, wherein the distal end of the strap is secured between a bottom surface of the horizontal arm and the top surface of the first structural roof member, wherein thereafter the distal end of the strap is secured between the top surface of the angled arm and the bottom surface of the top plate.

11. The method of claim 9, wherein the buckle comprises a first element, a second element and a third element, wherein the first element comprises a vertical arm, wherein the second element comprises an angled arm and wherein the third element comprises a horizontal arm, wherein the distal end of the strap is secured between the vertical arm of the buckle and the vertical side of the second structural roof member, wherein thereafter the distal end of the strap is secured between a bottom surface of the horizontal arm, wherein thereafter the distal end of the strap is secured between a top surface of the angled arm and the bottom surface of the top plate.

12. The method of claim 9, wherein the strap is galvanized.

13. The method of claim 9, wherein the strap is a straight strap.

14. The method of claim 9, wherein the first structural roof member comprises a load-bearing wall and the second structural roof member comprises a roof truss.

15. The method of claim 14, wherein the first structural roof member comprises a wooden top plate or a concrete tie beam.

16. The method of claim 9, wherein the connectors comprise wedge bolts, nails, screws or combinations thereof.

* * * * *